US005363604A

United States Patent [19]

Heyer

[11] Patent Number: 5,363,604

[45] Date of Patent: Nov. 15, 1994

[54] ENTANGLED CONTINUOUS FILAMENT NONWOVEN SCOURING ARTICLES AND METHODS OF MAKING SAME

[75] Inventor: Raymond F. Heyer, St. Paul, Minn.

[73] Assignee: Minnesota Mining and Manufacturing Company, St. Paul, Minn.

[21] Appl. No.: 933,388

[22] Filed: Aug. 21, 1992

[51] Int. Cl.[5] ..... B24D 11/02

[52] U.S. Cl. ..... 51/536; 51/296

[58] Field of Search ..... 51/394, 400, 402, 404, 51/293, 298, 295, 395; 15/209 R

[56] References Cited

U.S. PATENT DOCUMENTS

| | | | |
|---|---|---|---|
| 2,284,716 | 6/1942 | Benner | 51/394 |
| 2,451,915 | 10/1948 | Buresh | 19/59 |
| 2,700,188 | 1/1955 | Buresh et al. | 19/66 |
| 2,703,441 | 3/1955 | Langdon et al. | 19/156 |
| 2,744,294 | 5/1956 | Buresh et al. | 19/67 |
| 2,958,593 | 11/1960 | Hoover | 51/295 |
| 3,280,517 | 10/1966 | Copeland | 51/404 |
| 3,688,453 | 9/1972 | Legacy et al. | 51/400 |
| 3,788,999 | 1/1974 | Abler | 252/91 |
| 4,189,359 | 2/1980 | Limare et al. | 204/43 T |
| 4,190,550 | 2/1980 | Campbell | 252/93 |
| 4,227,350 | 10/1980 | Fitzer | 51/295 |
| 4,536,911 | 8/1985 | Demetriades | 51/394 |
| 4,622,253 | 11/1986 | Levy | 428/91 |
| 4,669,163 | 6/1987 | Lux et al. | 29/125 |
| 4,902,561 | 2/1990 | McCullough, Jr. et al. | 428/280 |
| 4,927,432 | 3/1990 | Budinger et al. | 51/298 |
| 4,931,358 | 6/1990 | Wahl et al. | 428/285 |
| 4,935,295 | 6/1990 | Serafini | 428/286 |
| 4,991,362 | 2/1991 | Heyer et al. | 51/404 |
| 5,025,596 | 6/1991 | Heyer et al. | 51/394 |

FOREIGN PATENT DOCUMENTS

| | | |
|---|---|---|
| 0492868A1 | 7/1992 | European Pat. Off. . |
| 1562843 | 3/1969 | France . |
| 2353690A1 | 5/1975 | Germany . |
| 92/01536 | 2/1992 | WIPO . |

OTHER PUBLICATIONS

"Guide to Nonwoven Fabrics", INDA (1978).

*Primary Examiner*—Bruce M. Kisliuk
*Assistant Examiner*—B. Bounkong
*Attorney, Agent, or Firm*—Gary L. Griswold; Walter N. Kirn; Jeffrey L. Wendt

[57] ABSTRACT

A low-density non woven abrasive article formed of a multiplicity of continuous, crimped, thermoplastic organic filaments having a portion of the filaments entangled with one another and having an organic thermoset binder which binds at least some of the filaments at points where they contact, performs well as a scouring article. The filaments of the article may further have abrasive particles adhesively bound thereto by the binder. The web of the low-density article is produced by entangling a plurality of substantially parallel, continuous, crimped, thermoplastic organic filaments, preferably by needlepunching, and coating the entangled web with a binder precursor solution or slurry.

5 Claims, 1 Drawing Sheet

ENTANGLED CONTINUOUS FILAMENT NONWOVEN SCOURING ARTICLES AND METHODS OF MAKING SAME

BACKGROUND OF THE INVENTION

1. Field of the Invention

This invention relates to low-density nonwoven scouring articles and methods of making same. More particularly, this invention relates to scouring articles comprising a plurality of continuous filaments entangled at a multiplicity of points along their length by needlepunching and having a binder resin coated thereon which further strengthens the articles and which may bind abrasive particles thereto.

2. Discussion of Related Art

The use of lofty, fibrous, nonwoven abrasive products for scouring surfaces such as the soiled surfaces of pots and pans is well known. These products are typically lofty, nonwoven, open mats formed of staple fibers which are bonded together at points where they intersect and contact each other. The staple fibers of low-density abrasive products of this type can be, and typically are, bonded together at points of contact with a binder that may or may not contain abrasive particles. The staple fibers are typically crimped, have a length of about 3.8 cm, a diameter ranging from about 25 to about 250 micrometers, and are formed into lofty open webs by equipment such as "Rando-Webber" and "Rando-Feeder" equipment (marketed by the Curlator Corporation, of Rochester, N.Y. and described in U.S. Pat. Nos. 2,451,915; 2,700,188; 2,703,441 and 2,744,294). One very successful commercial embodiment of such an abrasive product is that sold under the trade designation "Scotch-Brite" by Minnesota Mining and Manufacturing Company of St. Paul, Minn. ("3M"). Low-density abrasive products of this type can be prepared by the method disclosed by Hoover et al. in U.S. Pat. No. 2,958,593.

While such abrasive products have had excellent commercial success, their production requires a considerable investment in equipment. A "Rando-Webber" web-forming machine, for example, can cost in the thousands of dollars. Additionally, the fibers used to form the web of such abrasive products typically require chopping to produce staple fibers which is both costly and time consuming.

Low-density, lofty abrasive products may also be formed of webs or mats of continuous filaments. For example, in U.S. Pat. No. 4,227,350, Fitzer discloses a low-density abrasive product comprising a uniform cross-section, generally flat-surfaced, open, porous, lofty web of autogenously bonded, continuous, undulated, interengaged filaments. The web of Fitzer is formed by downwardly extruding a plurality of thermoplastic organic (e.g. polyamide, polyester) filaments from a spinneret into a quench bath. As the filaments enter the quench bath, they begin to coil and undulate, thereby setting up a degree of resistance to the flow of the molten filaments, causing the molten filaments to oscillate just above the bath surface. The spacing of the extrusion openings from which the filaments are formed is such that, as the molten filaments coil and undulate at the bath surface, adjacent filaments touch one another. The coiling and undulating filaments are still sufficiently tacky as this occurs, and, where the filaments touch, most adhere to one another to cause autogenous bonding to produce a lofty, open, porous, handlable filament web. The web, so formed, is then impregnated with a tough binder resin which adherently bonds the filaments of the web together and also bonds a multitude of abrasive granules, uniformly dispersed throughout the web, to the surface of the filaments. While these products have enjoyed success, their production does have disadvantages. As noted in the patent, one does not necessarily obtain a filament in the quenched web which is identical to the diameter of the extrusion orifice from which it was extruded, which may entail close scrutiny and adjustment of the web forming apparatus, which is time consuming. Further, the webs produced, while conformable to surface irregularities, have limited ability to stretch unless heated to a temperature which might melt the bonds. Adjustment of the degree of autogenous bonding of filaments is difficult without changing the spinneret orifice size or extrusion rate.

Additionally, fibrous polishing and/or abrading materials can be prepared from continuous or substantially continuous synthetic filaments by the method disclosed by Zimmer et al., in U.S. Pat. No. 3,260,582. In this method crimped or curled continuous filaments are straightened out under tension into a substantially parallel relationship with one another, uniformly coated while under tension with an adhesive which may or may not contain abrasive particles, interlocked with one another by release of such tension and then set in a permanently interlocked and lofty, open, 3-dimensional state by curing or setting up the adhesive. However, the continuous filaments of the finished web are substantially parallel, as show in FIG. 2 of the patent. Therefore, to afford a multidirectional high strength web, additional webs having filaments at an angle to the filaments of the first web must be layered onto the first web.

Low-density, lofty, open, porous, nonwoven scouring articles have been more easily and economically manufactured from continuous filaments by the method disclosed by Heyer et al., in U.S. Pat. Nos. 4,991,362, and 5,025,596. The scouring pads described in these patents comprise a multiplicity of crimped or undulated, continuous, thermoplastic organic filaments that are bonded together (e.g., by fusion or an adhesive) at opposite ends. The pad is made by arranging a multiplicity of continuous, crimped or undulated, thermoplastic organic filaments in an open lofty array, with one point of each filament in the array corresponding to a first filament bonding site and a second point of each filament, distant from the first point, corresponding to a second filament bonding site. A pad is formed in the filament array by bonding substantially all of the thermoplastic organic filaments together at the first and second bonding sites. When a pad having greater abrasiveness is desired, abrasive particles may be adherently bonded to the filaments of the pad, preferably before the individual pad is cut from the filament array. These pads have also enjoyed commercial success and are economical to make; however, some users prefer not to have the edges sealed, since they may present discomfort to the hand of the user. Thus, it would be advantageous if continuous filament scouring pads could be easily produced, but without the edge seals, while retaining strength after long time periods of scouring.

U.S. Pat. No. 4,190,550 (Campbell) discloses a seamless, fibrous, soap-filled pad which, when used as a bathing aid, imparts a cleansing and mildly stimulating rubbing action to human skin. A seamless envelope of crimped, resilient, stretchy synthetic staple or continuous organic fibers surrounds a core of solid soap or other surfactant material and is held in integral form solely by the interentanglement of the fibers, such as by needling. The particular problem to be solved was to produce a soap-containing, pad-like article suitable for use on human skin, rather than an article intended for scouring pans or other non-human surfaces. Further, the articles of Campbell, even if suitable for use as a scouring article, do not have the degree of openness required to perform as a kitchen scouring article since when compressed under pressure the nonwoven material is pressed against the bar of soap.

Other background references include U.S. Pat. Nos. 3,688,453; 4,622,253; 4,669,163; 4,902,561; 4,927,432; 4,931,358; and 4,935,295; ; World Patent Application No. WO 92/01536, published Feb. 6, 1992; European Patent Application number 0 492 868 A1, published Jul. 1, 1992; and "Guide to Nonwoven Fabrics", published 1978 by INDA, an association of the nonwoven fabrics industry.

Producers of the scouring pads are invariably seeking ways to minimize cost in manufacturing scouring and abrasive pads and/or tailor the pads for specific uses. The invention described herein is drawn to such methods and articles. To the inventor's knowledge there has not been commercialized or otherwise disclosed an entangled nonwoven scouring article made from continuous, crimped or undulated organic thermoplastic filaments having a binder resin which further strengthens the nonwoven entangled web.

SUMMARY OF THE INVENTION

In accordance with the present invention a nonwoven scouring article is presented comprising a low-density, lofty, open, porous, nonwoven web, the web comprising a multiplicity of crimped or undulated, continuous, preformed thermoplastic organic filaments, at least partially coated with an organic thermoset binder which binds the filaments at least at a portion of points where they contact. The continuous thermoplastic organic filaments, preferably in the form of tow, are entangled together at a multiplicity of points along their length to provide a cross-direction tensile strength the web (test described in Test Methods section below) of at least about 0.02 kg/cm, more preferably at least about 0.03 kg/cm, before coating the web with a thermosetting binder precursor solution. (As used herein the term "cross-direction" means all directions perpendicular to the machine direction. "Machine direction", of course, is the direction the web passes through the various process equipment, as explained in more detail below.)

The continuous filaments are "entangled", preferably by needlepunching from a plurality of directions perpendicular to the machine direction. As used herein the term "entangled" means that a plurality of the originally substantially parallel crimped or undulated continuous filaments are randomly tortuously contacted with their companion filaments. The filaments are not melted together; rather, the flexibility of the filaments, as determined by their composition, denier, crimp index, and other properties, essentially interlocks the filaments, greatly increasing the strength of the resulting web.

The nonwoven scouring article may have a plurality of abrasive or non-abrasive filler particles adherently bonded to the filaments by the binder (as used herein "binder" denotes a cured binder precursor solution). For efficient scouring of hard food residues the abrasive particles preferably have a hardness greater than about 3 Mohs, more preferably at least about 7 Mohs.

The method of producing the articles of the invention comprises arranging a multiplicity of continuous, crimped or undulated, preformed thermoplastic organic filaments into an open, lofty array of substantially parallel continuous, crimped or undulated filaments. The substantially parallel arrangement of filaments is then subjected to conditions, such as needlepunching with one or more barbed needles or a pressurized fluid stream, so that a sufficient amount of the filaments are entangled to provide the above-mentioned minimum cross-direction tensile strength. The entangled continuous filament web is then coated with a binder precursor solution and then subject to conditions suitable for curing the precursor, such as heat, radiation, a combination of heat and radiation, and the like, as is commonly known. The coated entangled continuous filament web is then separated into individual scouring articles by means such as a blade, laser beam, or the like. The binder precursor solution may include abrasive or non-abrasive particles (in which case the binder precursor "solution" may be a slurry) which may be coated onto the entangled web. The binder precursor slurry is then subjected to conditions sufficient to cure the binder precursor solution. Alternatively, rather than applying a binder precursor slurry to the entangled continuous filament web, the entangled continuous filament web may be first coated with a binder precursor solution, after which abrasive articles are deposited throughout the binder precursor solution-coated entangled continuous filament web. The coated entangled continuous filament web is then subjected to conditions sufficient to cure the binder precursor solution.

BRIEF DESCRIPTION OF THE DRAWING

The features of the present invention can best be understood by reference to the accompanying drawing, wherein.

DESCRIPTION OF PREFERRED EMBODIMENTS

The open lofty filament array useful in the present invention may be formed by assembling individual crimped or undulated filaments, or by spreading apart (opening) tow. Tow is a commercially available, crimped rope-like bundle of continuous, extruded organic filaments. Tow typically is a highly compacted product in which adjacent filaments contact each other over a large percentage of their lengths and, therefore, requires opening to form an open, lofty array. Tow may be opened by conventional methods such as stretching the tow under tension in its lengthwise direction and then releasing the tension and allowing the tow to relax, as disclosed in U.S. Pat. No. 2,926,392, Jackson, incorporated herein by reference.

Filaments useful in the present invention are preferably extruded from organic thermoplastic polymeric materials. Preferably, the thermoplastic material has a break strength of at least 1 gram per denier to provide the necessary degree of toughness for prolonged use as a scouring article. Useful filament-forming polymeric materials include polyamides such as polycaprolactam and polyhexamethyleneadipamide (e.g. nylon 6 and nylon 6,6) polyolefins, (e.g., polypropylene and polyethylene), polyesters (e.g., polyethylene terephthalate), and the like. Useful filaments can range in size from about 6 denier to about 400 denier, although filaments ranging from 6 to 200 denier are preferred. When commercially available tow is the source of these filaments, the tow should be crimped by conventional methods such as a stuffer box, a gear crimper or the like.

Figure 1:
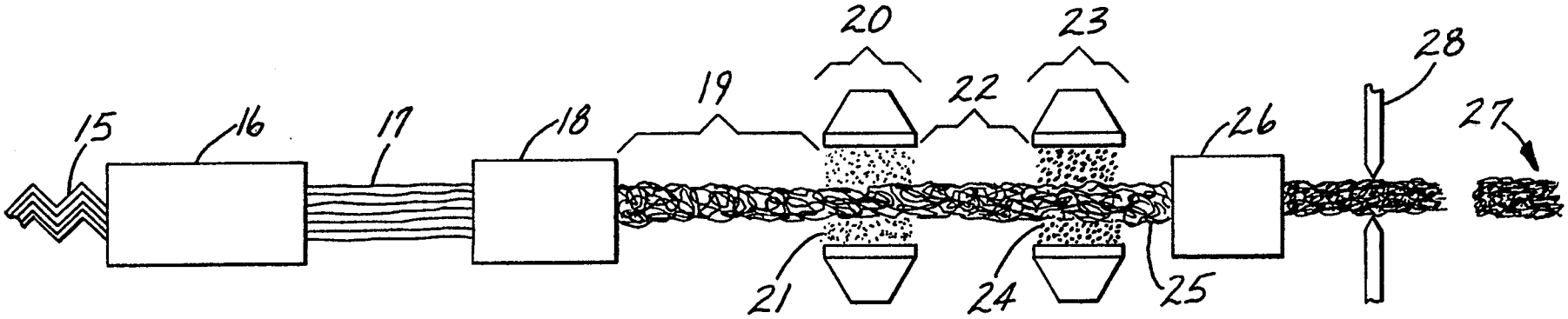
FIG. 1 is a schematic illustration of a process useful in making the abrasive pads of the invention from tow.

As shown in FIG. 1, tow 15 is opened in tow opening station 16 to form an open lofty array 17 of substantially parallel, crimped continuous filaments. Thereafter, the open lofty filament array 17 passes through an entanglement station 18, wherein the filaments are substantially entangled by means for entangling, such as a multiplicity of barbed needles which reciprocate generally normal to the machine direction, to form an entangled continuous filament web 19. Multiple directions perpendicular to machine direction are preferred. In a batch mode of operation, the needling may be accomplished "by hand"; in this case, web 17 is held in the hand or other suitable holding means and one or more barbed needles pushed into and alternatingly out of the web from all direction perpendicular to machine direction.

Alternatively but less preferably, web 17 can be entangled by one or more moving, narrow, pressurized streams of fluid, such as water. If water streams are used, the process is typically known in the nonwoven industry as "hydroentanglement" or "spunlacing" (see "Guide to Nonwoven Fabrics", mentioned earlier, at page 21, incorporated by reference herein. Since hydroentanglement or spunlacing is typically performed on nonwovens made from staple fibers, and since the corresponding process performed on continuous filaments requires very high water pressure streams, the hydroentanglement method is not viewed as the preferred mode of entangling the filaments of web 17.

Entangled web 19, although sufficiently abrasive for many uses, is passed through a spray coating station 20 and coated with a thermosetting binder precursor solution 21 which will cure, under conditions which will not damage the filament array, to a tough adherent binder material.

Examples of suitable thermosetting binder precursor solutions include aqueous emulsions and solvent solutions of epoxy, melamine, phenolic, isocyanate and isocyanurate resins, and varnish. Various conventional web coating techniques such as dip coating, roll coating, and spray coating may be used to coat entangled continuous filament web 19 with binder precursor solution 21, the choice depending on economic and environmental constraints. For example, spray coating may be preferred as it provides more control over the amount of binder precursor solution being applied to the filaments of the entangled web array than dip coating, and has less impact on the loftiness of the entangled web than roll coating. However, roll coating may be preferred where it is desired to reduce waste of binder precursor solution or slurry, as spray coating tends to produce an overspray (spray which does not hit the web or which passes entirely through the web).

Thereafter, the binder precursor solution coated entangled web 22 may be passed through abrasive particle coating station 23 and coated with abrasive particles 24. Conventional abrasive granule coating techniques, such as drop coating, electrostatic coating, and spray methods similar to those used in sand blasting, except with milder conditions, may be used to coat binder precursor solution coated entangled web 22 with abrasive particles. Alternatively, a binder precursor slurry of abrasive particles in a binder precursor solution may be applied to entangled web in a single coating application by conventional means. Alternatively, the binder precursor solution coated web may bypass the granule coating step and proceed directly to a curing station.

The binder precursor coated entangled web 22 or binder precursor and abrasive particle coated entangled web 25 is then passed through a forced air oven 26 or equivalent heating means to cure or set the binder precursor solution (and bond the abrasive particles to the filaments, if used), before being cut into individual scouring articles 27 by blades 28 or other cutting means.

Figure 2:
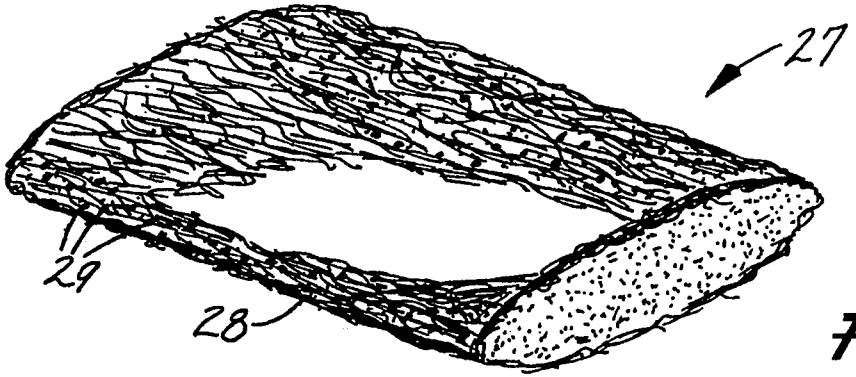
FIG. 2 is a perspective view of an individual scouring article of the invention made in accordance with the process of the invention.

As illustrated in FIG. 2, individual scouring articles 27 comprise a multiplicity of continuous, crimped or undulated, entangled thermoplastic organic filaments 28. The filaments are sufficiently entangled to provide a cross-direction tensile strength before coating (measured in accordance with the procedures detailed in the Test Methods section) of at least about 0.02 kg/cm, more preferably at least about 0.03 kg/cm, in substantially all (preferably all) directions perpendicular to machine direction. FIG. 2 illustrates a scouring article 27 having optional individual or agglomerated abrasive particles 29 adherently bound to individual filaments 28. It will further be recognized that abrasive article 27 of the invention may be bonded at its edges, such bonding being performed by heat-sealing, using a suitable adhesive composition, or equivalent means. Heat-sealing (fusing the thermoplastic filaments together with heat) is described in assignee's U.S. Pat. Nos. 4,991,362 and 5,025,596, incorporated by reference herein. If it is desired to heat-seal the edges of the scouring article, the preferred method of heat-sealing the filaments together is by heat-sealing with an ultrasonic heat-sealing press such as that known under the trade designation "Branson Sonic Sealer" available from Branson Sonic Power Company of Danbury, Conn. Some users prefer to use the heat-sealed edges as scraping edges, and the edges may provide some advantages in packaging the articles.

Abrasive particles useful in the scouring articles of the invention preferably have a Mohs hardness greater than about 3 Mohs, more preferably at least about 7 Mohs. Abrasive particles meeting these requirements include materials such as silicon carbide, aluminum oxide, topaz, fused alumina-zirconia, boron nitride, tungsten carbide, and silicon nitride. Non-abrasive particles and mixtures of abrasive and non-abrasive particles may also be used.

The particle size of the abrasive particles, when used, can range from about 80 grade (average diameter of about 200 micrometers) to about 280 grade (average diameter of about 45 micrometers) or finer. However, when used in a kitchen or bathroom scouring pad, the preferred average particle size of the abrasive particles should be on the order of about 45 micrometers or finer, to provide an aggressive abrasive surface capable of scouring pots and pans that are soiled with baked-on or burned cooking residues without harmful scratching.

The scouring articles of the invention may take any of a variety of shapes and sizes. For example, the scouring article maybe circular, elliptical, or quadrangular. However, the preferred scouring article is rectangular and is of the size and bulk to be easily grasped in the hand of the user. Preferably, the scouring article is from about 5 to 15 cm in length, from about 5 to 10 cm in width, and from about 1 to 5 cm in thickness.

The most preferred embodiment of the present invention comprises a rectangular pad with the length approximately 7 cm, a width of approximately 5 cm, and a thickness of approximately 3 cm, having 280 grade, or finer, aluminum oxide abrasive particles adhered to the crimped or undulated continuous entangled filaments by an isocyanurate or phenolic resin binder formed from a binder precursor solution. However, it is within the scope of the invention to include other ingredients in the scouring articles such as pigments, fillers, or other additives. It may be desired, for example, to impregnate the pad with a cleansing composition such as that disclosed in U.S. Pat. No. 3,788,999 or U.S. Pat. No. 4,189,395.

It may be preferred in some applications to improve the adhesion of phenolic resins, if used, to polyester fibers by the treatment of either of webs 16, 17 or 19 illustrated in FIG. 1 with ultraviolet light as disclosed and described in assignee's copending European Patent Application number 0 492 868 A1, published Jul. 1, 1992, incorporated by reference herein. If used, the UV energy employed is generally above about 200 milliJoules/cm$^2$, but less than about 1000 milliJoules/cm$^2$. However, it has been found that when tow is opened, unless the opened bundle is flattened before irradiating, little benefit is seen in scouring efficiency.

The invention is further illustrated by the following non-limiting examples and test methods, wherein all parts and percentages are by weight or unless otherwise specified.

TEST METHODS

Test Methods I and II: Tensile Strength of Needled but Uncoated Webs

In Test Method I, only a part of the width of specimens which were needled but uncoated with binder precursor solution or slurry were gripped in the jaws of a tensile testing machine (i.e, a portion of the width on both sides was not gripped by the jaws). The jaws used had a width of 5 cm. Specimen size used was 100 mm in length, with about 32 mm of the specimen defining the initial spacing between the jaws. A constant-rate-of-traverse tensile testing machine (known under the trade designation "Sintech") was used, using a machine speed of 12.7 cm per minute. The peak load before break, in kg, was recorded and divided by the width of the jaws to give the tensile strength of the specimen before application of the binder precursor.

Test Method II was essentially the same as Test Method I, except with the following changes. The tensile testing machine was that known under the trade designation "Instron Model TM". The samples were 50 mm long rather than 100 mm. Rather than inserting the sample into the jaws of the tensile testing machine, fish hooks were inserted into both the upper and lower jaws. Four treble hooks, each with one hook removed, were fashioned into "double hooks" by cutting off one hook from commercially available treble fish hooks. The shanks of two of the double hooks were placed in the upper jaw of the machine so that the spacing between hooks was approximately equal (about 1 cm apart). Two double hooks were similarly placed in the lower jaw. The spacing between the upper and lower hooks was about 3 cm. Samples were easily positioned so that all eight hooks were engaged.

Test Method III: Scouring Test of Needled, Coated Webs

Needled, coated scouring articles made in accordance with the invention were tested to determine their effectiveness in removing a burned-on standard food soil from a stainless steel panel.

5.1 cm by 22.9 cm stainless steel panels were coated using the mixture as follows. An oven was preheated to 232° C. Meanwhile, 2 grams of food soil composition was placed near one end of the stainless steel panel to be coated and the panel placed on a flat surface. A coating rod known under the trade designation "RDS #60" was placed in contact with the food soil and the coating rod pulled (not rolled) across the entire length of the panel after which the rod was traversed in the opposite direction to the starting point. For each panel coated this step was repeated, for a total of four coating passes.

Coated panels were then placed on a metal cookie sheet and the sheet placed in the preheated oven for 30 minutes at 232 ° C. After 30 minutes the panels were removed from the oven and allowed to cool to room temperature.

Second and third food soil coatings were formed on the panels over the first coating exactly as described for the first coating (i.e, coating, baking, cooling for the second coating and similarly for the third coating). The coated panels were then allowed to cool to room temperature for 24 hours.

A coated panel was then placed into a slotted tray in a tank of water and a scouring pad to be tested was secured in a standard weighted holder (total weight of holder 2.5 kg) in a Heavy Duty Gardner Wear Tester (commercially available from Gardner Laboratory, Inc. of Bethesda, Md.) so that 0.32 cm of the scouring article extended out of the holder, and the holder and article passed back and forth over the surface of the coated panel to complete one cycle. Once the scouring article was secured properly in the holder, the tank of water had a dishwashing detergent (commercially available from the Proctor and Gamble Company of Cincinnati, Ohio, known under the trade designation "Ivory") added thereto in an amount of 2 ml of detergent per 250 ml of water. The test was started immediately after addition of the soap to the water in each case, with the automatic counter set to zero.

The removal of food soil was carefully observed. At the initial visual observation of the removal of food soil, the machine was stopped and the panel immediately removed. A transparent scanning chart was then placed over the soiled panel, and the number of completely cleaned squares recorded. Also, the number of $\frac{3}{4}$ clean squares or greater were counted, as well as the number of $\frac{1}{4}$ clean or less squares. The number of half clean squares was then determined by the number of $\frac{1}{4}$ clean squares minus the number of $\frac{3}{4}$ clean squares. The number of cycles on the automatic counter were noted.

The partially cleaned panels were then placed back into the water bath tray and the machine immediately started, without resetting the automatic counter. The number of cycles needed to remove 90% of the food soil was determined and recorded.

EXAMPLES

Example 1

Fiber in tow form, comprising continuous 50 denier stuffer box crimped polyester filaments, with 2500 filaments in the tow bundle, was opened by stretching and relaxing it in a conventional manner. The opened tow bundle was then needlepunched from all directions normal to the general direction of the tow filaments. This operation was done by hand with two needles held between the fingers in each case. The needles used were Torrington 77-0961 125, 15×18×25×3.5, regular barb. The amount of needlepunching was quite light (needling was done for approximately 5–10 minutes to complete a 50 cm long tow bundle) and the resulting product was compressed to about 50% of its original loft. The needled tow was then cut to about 9 cm lengths. This procedure (opening, needling, and cutting) was repeated to produce a total of 10–12 samples.

The needlepunching provided cross direction strength to the needlepunched webs as compared to the loose tow bundles. The cross direction tensile strength for opened tow (before needling) was variously computed as 0 kg/cm up to about 0.01 kg/cm. The average cross direction tensile strengths measured by Test Method I for 5 needled webs produced in Example 1 was 443.4 gm/5 cm, or 0.089 kg/cm, with the minimum of the samples tested by that method being 241.8 gm/5 cm, or 0.048 kg/cm. The average cross direction tensile strengths measured by Test Method II for five needled webs produced in Example 1 was 143.2 gm/5 cm, or 0.029 kg/cm, with the values thrown out where it was obvious that a filament was caught on a hook attached to both the upper and lower jaws. Comparing the results of the two tests, it is evident that Test Method II provides a result which is a truer measure of the cross-direction tensile strength of the needled webs since there was less chance for a filament to extend from a lower hook to an upper hook.

Five of the needlepunched tow bundles were then roll coated by conventional means with a binder precursor slurry having the composition shown in Table 1.

The needlepunched-slurry-coated webs were allowed to dry to a dry coating weight of approximately 2 grams of binder and abrasive per gram of non-coated web (each web having a length of approximately 7 cm, a width of approximately 5 cm and a thickness of approximately 3 cm). The phenolic slurry coating was then heated in an oven at 165° C. for about 10 to 15 minutes to cure the phenolic binder precursor solution.

TABLE 1

| Ingredients | Amount in weight percent |
|---|---|
| A-stage base catalyzed phenol-formaldehyde resin (70% solids)[1] | 36.81 |
| isopropyl alcohol | 2.47 |
| deionized water | 9.88 |
| aluminum oxide (grade 240 and finer particles)[2] | 46.50 |
| black pigment[3] | 0.25 |
| white pigment[4] | 3.50 |
| suspending agent[5] | 0.50 |
| silicone anti-foaming agent[6] | 0.10 |

[1]Available from Reichold Chemical, having formaldehyde/phenol ratio of 1.96:1, 2% KOH as base catalyst
[2]available from 3M
[3]internally generated at 3M, including carbon black known under the trade designation "Monarch 120", from Cabot Corporation; phenolformaldehyde resin as mentioned above in this Table 1; and a mixture of propylene glycol monomethylether and ethylene glycol monomethylether
[4]known under the trade designation "AquaSperse", number 877-0018, from Huls-America, Piscataway, NJ
[5]known under the trade designation "CAB-O-SIL", from Cabot Corp., Tuscola, IL
[6]known under the trade designation "Q23168 Anti-Foam Emulsion", from Dow Corning Corp., Midland, Mi For purposes of comparison a commonly used kitchen scouring article was compared to the scouring articles of Example 1 according to the scouring method described above. The results of these tests are reproduced in Table 2.

TABLE 2

| Example Designation | Cycles to 90% Clean |
|---|---|
| 1 (average of 3 runs) | 378 |
| 3M "No Rust Wool Soap Pads" | 294 |

A lower number of cycles represents a more efficient scouring pad. The data presented in Table 2 indicates that the scouring pads of Example 1 were about as effective as the 3M Brand "No Rust Wool Soap Pad", considering the small number of pads tested. It is quite valid to say that an effective scouring product could be made in this matter.

The above examples are for illustration purposes only, and are not intended to limit the scope of the appended claims.

What is claimed is:

1. A method of making a nonwoven abrasive or scouring article of the type comprising a low-density, lofty, open, porous, nonwoven web, the web comprising a multiplicity of crimped or undulated, continuous, preformed thermoplastic organic filaments, said filaments entangled together at a multiplicity of points along their length sufficient to provide a cross-direction tensile strength of the web of at least about 0.02 kg/cm before application of a binder precursor, said filaments at least partially coated with an organic binder which binds said filaments at least at a portion of points where they contact, said method comprising the steps of:
   (a) arranging a multiplicity of continuous, crimped or undulated, continuous, preformed thermoplastic organic filaments into an open lofty array of a multiplicity of substantially parallel continuous filaments;
   (b) entangling said multiplicity of substantially parallel continuous filaments together to form an entangled continuous fiber web employing means for entangling so that said entangled web has a cross direction tensile strength of at least about 0.02 kg/cm;
   (c) coating the entangled continuous fiber web with a binder precursor solution;
   (d) subjecting the product of step (c) to conditions sufficient to cure the binder precursor solution, thereby forming an entangled continuous fiber web having a binder; and
   (e) separating the product of step (d) into individual scouring articles.

2. Method in accordance with claim 1 wherein the binder precursor solution of step (c) includes abrasive particles.

3. Method in accordance with claim 1 wherein said arranging step (a) comprises opening a substantially continuous length of crimped tow.

4. Method in accordance with claim 1 wherein said means for entangling is a set of barbed needles which reciprocate in a plurality of directions normal to machine direction.

5. Method in accordance with claim 4 wherein said barbed needles have multiple barbs.

* * * * *